US006382196B2

(12) United States Patent
Kawamoto et al.

(10) Patent No.: US 6,382,196 B2
(45) Date of Patent: May 7, 2002

(54) V-TYPE TWO CYLINDER ENGINE AND STRADDLE-TYPE FOUR WHEEL ALL TERRAIN VEHICLE HAVING IT MOUNTED THEREON

(75) Inventors: Yuichi Kawamoto; Yasuhiro Kuji; Masao Mikasa, all of Hyogo (JP)

(73) Assignee: Kawasaki Jukogyo Kabushiki, Hyogo (JP)

( * ) Notice: Subject to any disclaimer, the term of this patent is extended or adjusted under 35 U.S.C. 154(b) by 0 days.

(21) Appl. No.: 09/736,528

(22) Filed: Dec. 12, 2000

(30) Foreign Application Priority Data

Dec. 16, 1999 (JP) ..... 11-356798
Feb. 7, 2000 (JP) ..... 2000-028979
Mar. 1, 2000 (JP) ..... 2000-055178

(51) Int. Cl.[7] ..... F02M 13/04
(52) U.S. Cl. ..... 123/580; 123/579
(58) Field of Search ..... 123/579, 580

(56) References Cited

U.S. PATENT DOCUMENTS 2,766,743 A * 10/1956 Platner et al. ..... 123/580
4,094,283 A * 6/1978 Sutton ..... 123/579
4,517,940 A * 5/1985 Koyanagi et al. ..... 123/580
5,367,998 A * 11/1994 Shiohara et al. ..... 123/580
6,269,799 B1 * 8/2001 Watanabe et al. ..... 123/579

FOREIGN PATENT DOCUMENTS

JP 01172083 A 6/1989

* cited by examiner

*Primary Examiner*—Paul J. Hirsch
(74) *Attorney, Agent, or Firm*—Oppenheimer Wolff & Donnelly LLP

(57) ABSTRACT

A V-type two cylinder engine comprises: cylinders arranged forward and rearward such that they are inclined in V shape; a downdraft carburetor unit placed between the cylinders and including twin venturi bores provided for the respective cylinders and an air vent system making interior of carburetors communicate with atmosphere; intake manifolds each connecting a venturi bore of each of the carburetors to an intake port of a corresponding cylinder; and an air cleaner placed above the carburetors such that it covers the carburetors, and the carburetor unit is placed obliquely seen in a plan view according to positional difference between the cylinders in a direction of a crank shaft of the engine such that the venturi bore of each of the carburetors is closer to the intake port formed in a corresponding cylinder.

15 Claims, 14 Drawing Sheets

V-TYPE TWO CYLINDER ENGINE AND STRADDLE-TYPE FOUR WHEEL ALL TERRAIN VEHICLE HAVING IT MOUNTED THEREON

BACKGROUND OF THE INVENTION

1. Field of the Invention

The present invention relates to a V-type two-cylinder engine suitable for being mounted on an all terrain vehicle (referred to as ATV), and a straddle-type four wheel all terrain vehicle on which the engine is mounted.

2. Description of the Related Art

Some motor cycles include V-type two cylinder engines mounted thereon. The V-type two cylinder engine has an advantage over other type engines having the same engine displacement in that a width (dimension in a longitudinal direction of a crank shaft) of the engine can be reduced because cylinders can be placed such that they are partially overlapped seen in a front view (seen from a direction orthogonal to the crank shaft). For this reason, the V-type two-cylinder engine is suitable for a straddle-type vehicle.

In the prior art, there has been proposed an all terrain vehicle on which the V-type two-cylinder engine is mounted. This all terrain vehicle has an engine in which a carburetor is provided between forward and rearward cylinders arranged in V shape and an air cleaner is provided above the carburetor and covered with a cover situated above (see Japanese Laid Open Publication No. Hei. 1-172083). However, with this configuration, the following technical problems arise.

(a) When two carburetors are provided according to placement of respective cylinders to obtain suitable performance for various operating conditions of the all terrain vehicle, it is impossible to place them on an axis parallel to the crank shaft like an inline-shaped engine, because these cylinders are arranged in V shape and placed as having positional difference between them in a direction of the crank shaft. Accordingly, each of the carburetors is independently placed for each of the cylinders at an appropriate position adapted to a position of each of the cylinders.

In this case, it is necessary to set up a throttle lever, a choke lever, and the like for each of the carburetors and provide fixing members having high rigidity and complex shapes for fixing the carburetors at predetermined positions, fixing members for the air cleaner, and a cooperating mechanism for cooperating levers of the carburetors. In this case, the entire intake equipment including the two carburetors has a complex structure and the number of parts is increased. As a consequence, man-hour of assemblies is increased and hence, a manufacturing cost is increased. Japanese Utility Model Application Publication No. Sho 60-66862 discloses such a prior art.

When the V-type two cylinder engine is configured such that the carburetors are placed in parallel on an axis orthogonal to the crank shaft, a distance between an intake port of one cylinder and a venturi bore (exit of fuel-air mixture of an carburetor) of the corresponding carburetor differs from a distance between an intake port of the other cylinder and a venturi bore of the corresponding carburetor. Accordingly, two intake manifolds each connecting the intake port and the venturi bore have different lengths and are curved at the middle thereof. Such a configuration is less preferable to engine performance and a manufacturing cost of the intake manifolds is high because of complex shapes.

(b) Since the all terrain vehicle is limited in space, the air cleaner might be placed immediately above the carburetors such that it covers the carburetors. In case of the all terrain vehicle traveling in atmosphere in which water or mud is flying in all directions, the air cleaner or the like requires any measures to prevent attachment (adherence) of the mud or water to a filter of the air cleaner.

(c) While an air bent tube for making the interior of the carburetor communicate with atmosphere and guiding an opening thereof to a desirable position might be extended below the air cleaner, it is required that a predetermined length of the air bent tube be horizontally placed below the air cleaner. With such a configuration, fuel is accumulated in the horizontally extended portion of the air vent tube and a primary function of the air bent tube for making the interior of the carburetor communicate with atmosphere is impeded. Further, the position of the opening of the air vent tube is restricted by parts around the carburetors.

SUMMARY OF THE INVENTION

The present invention has been developed for the purpose of obviating the above-described problems, and a first object of the present invention is to provide a V-type two cylinder engine suitable for a straddle-type four wheel all terrain vehicle that includes a compact intake equipment having a simple configuration and being manufactured at a low cost, in which a distance between an intake port of one cylinder and a venturi bore of the corresponding carburetor is equal to a distance between an intake port of the other cylinder and a venturi bore of the corresponding carburetor and connecting members and the like for connecting these parts are less curved.

A second object of the present invention is to provide a V-type two cylinder engine suitable for a straddle-type four wheel all terrain vehicle, comprising an air cleaner with improved maintainability and compactness that is capable of reducing attachment (adherence) of water, mud or the like contained in introduced air to a filter, with a compact configuration.

A third object of the present invention is to provide a V-type two cylinder engine suitable for a straddle-type four wheel all terrain vehicle comprising an air vent system of carburetors that is capable of preventing fuel from being accumulated in an air vent tube with a simple configuration and freely setting a position at which the air vent tube is opened in atmosphere and has a superior external design appearance when an air cleaner is placed above the carburetors.

A fourth object of the present invention is to provide a straddle-type four wheel all terrain vehicle on which the above-described V-type two-cylinder engine is mounted.

To achieve the first object of the present invention, there is provided a V-type two cylinder engine of the present invention comprising: cylinders arranged forward and rearward such that they are inclined in V shape; a downdraft carburetor unit placed between the cylinders and including twin venturi bores provided for the respective cylinders and an air vent system making the interior of carburetors communicate with atmosphere; intake manifolds each connecting a venturi bore of each of the carburetors to an intake port of a corresponding cylinder; and an air cleaner placed above the carburetors such that it covers the carburetors, wherein the carburetor unit is placed obliquely seen in a plan view according to positional difference between the cylinders in a direction of a crank shaft of the engine such that the venturi bore of each of the carburetors is closer to the intake port formed in a corresponding cylinder.

In the V-type two cylinder engine so configured, a distance between an intake port of one cylinder and a venturi bore (opening through which fuel-air mixture is supplied from the carburetor to the cylinder) of the corresponding carburetor can be made equal to a distance between an intake port of the other cylinder and a venturi bore of the corresponding carburetor and these distances can be made short. Besides, the intake manifolds are short and less curved. Therefore, this configuration is preferable to improvement of engine performance. Further, the carburetor unit, the air cleaner, and the like are efficiently placed in a space above the engine, which has been conventionally a dead space, and a distance from the air cleaner to the cylinder is short and connecting members for connecting these parts are less curved. Such a configuration, in addition to placement of the carburetors, realizes an efficient and compact intake equipment and a V-type two cylinder engine suitable for a straddle-type four wheel all terrain vehicle.

It is preferable that the carburetor unit is placed obliquely such that the venturi bore of each of the carburetors is situated on an extended line of an intake passage formed in a corresponding cylinder. Thereby, the distance between the intake port of the cylinder and the corresponding carburetor can be made equal to the distance between the intake port of the other cylinder and the corresponding carburetor and these distances can be made short. Besides, the connecting members and the like for connecting these parts are less curved.

It is preferable that the venturi bore of each of the carburetors is placed substantially on a line extending in a direction orthogonal to the crank shaft through the intake port of a corresponding cylinder.

To achieve the second object of the invention, the air cleaner of V-type two cylinder engine comprises: a body having an intake hole provided in a side face thereof and connecting holes connected to the carburetors; an intake duct connected to an inlet of the intake hole; a guide passage provided inside of the body and at an outlet of the intake hole for guiding air flowing through the intake hole upward; and a filter placed inside of the body such that it separates a portion downstream from the guide passage into a dirty area continuous with the guide passage and a clean area in which the connecting holes are opened, for filtering air flowing through the guide passage toward the connecting holes.

Such a configuration provides a V-type two cylinder engine comprising the air cleaner in which air flowing through the intake hole formed in the side face thereof collides with a wall face of the guide passage that is opposite to the outlet of the intake hole, and the water, mud or the like contained in the air is attached to the wall face of the guide passage or dropped downward.

It is preferable that the intake hole is provided in a lower end portion of the side face of the body, the intake duct extends obliquely and downward from a tip end thereof and reaches the inlet of the intake hole, the filter is provided in a substantially horizontal direction to allow air flowing through the guide passage to pass through the filter from above and move downward toward the connecting holes, thereby forming a dirty area above the filter and a clean area below the filter with a wall disposed between the guide passage and the clean area, and the connecting holes are provided in a bottom face of the clean area of the body.

With such a configuration, the air cleaner adapted to move the introduced air upward can be made as low as possible. In addition, an effective area of the filter can be made larger without a substantial increase in the height of the air cleaner. Further, the air passing through the filter moves downward and clean air can be efficiently introduced to downdraft carburetors.

It is preferable that the intake duct has a passage section area gradually increased from the tip end thereof to the base end thereof. Since the flow velocity of the air introduced through the tip end of the intake duct is gradually reduced, the water, mud or the like can be efficiently removed when the air collides with the wall face of the guide passage.

To achieve the third object, in the V-type two cylinder engine, each of the carburetors of the carburetor unit comprises a float chamber and an air vent passage making the float chamber communicate with atmosphere, and the air vent passage is guided to inside of the body of the air cleaner, where the air vent passage slopes up to a highest point from which the air vent passage slopes down.

The air vent passage does not include a long horizontal portion. Therefore, if the fuel goes into the air vent passage from the float chamber of the carburetor during traveling of the vehicle, gravity applied on the fuel in the air vent passage cause the fuel to return to the float chamber. This prevents accumulation and clogging of the fuel in the air vent passage. As a consequence, a pressure in the float chamber of the carburetor is stabilized. Moreover, the opening of the air vent passage can be provided at a suitable position by utilizing the space in the air cleaner without being restricted by the carburetors or parts around the carburetors and such a configuration has an excellent external design appearance.

It is preferable that the air vent passage comprises an inner air passage making the float chamber of the carburetor communicate with atmosphere and an outer air passage extended from the inner air passage, and the outer air passage comprises: a first outer air passage extending from an outlet of the inner air passage through inside of the air cleaner to an exit portion provided in the air cleaner; and a second outer air passage extended from the exit portion of the air cleaner, and a tip end of the second outer passage is opened in atmosphere.

Thereby, the opening of the air vent passage can be easily provided at a suitable position with a simple configuration.

It is preferable that the second outer air passage extends downward from the exit portion provided in the air cleaner, and an intermediate air vent hole is provided in the exit portion so as to open a base end of the second outer air passage opened in atmosphere.

With such a configuration, the air vent system is suitable for the straddle-type four wheel all terrain vehicle traveling in water or on rough terrain with much dust.

To achieve the fourth object, there is provided a straddle-type four wheel all terrain vehicle comprising: a straddle-type seat; a steering handle provided forward of the seat; a top cover covering an upper portion of a vehicle body, through which a rotating shaft of the steering handle penetrates; and a V-type two cylinder engine mounted below the seat and the handle an between the seat and the handle, wherein the V-type two cylinder engine comprises: cylinders arranged forward and rearward such that they are inclined in V shape; a downdraft carburetor unit placed between the cylinders and including twin venturi bores provided for the respective cylinders and an air vent system making interior of carburetors communicate with atmosphere; intake manifolds each connecting a venturi bore of each of the carburetors to an intake port of a corresponding cylinder; and an air cleaner placed above the carburetors such that it covers the carburetors, wherein the carburetor unit is placed obliquely seen in a plan view according to positional difference between the cylinders in a direction of a crank shaft of the engine such that the venturi bore of each of the carburetors is closer to the intake port formed in a corresponding cylinder.

According to the straddle-type four wheel all terrain vehicle so configured, the V-type two cylinder engine with high performance can be compactly mounted in a space below the straddle-type seat and the steering handle situated forward of the seat and between the seat and the handle, and the vehicle is easy for the rider to straddle in a width direction thereof.

It is preferable that in the straddle-type four wheel all terrain vehicle, a relay chamber is formed inside of the top cover, the relay chamber being surrounded by a separating wall and having a clearance between a rotating shaft of the handle and the top cover, for introducing fresh area, and an opening of the air cleaner for introducing fresh area is opened inside of the relay chamber.

With such a configuration, since the opening of the air cleaner for introducing fresh area can be provided in an upper and central portion of the vehicle body and is covered with the top cover, the water or mud and the like hardly enters the opening. Besides, the opening can be simply structured and formed around the rotating shaft of the handle and just before a rider. Therefore, if the opening is clogged with foreign substances, they can be found immediately and removed.

It is preferable that in the straddle-type all terrain four wheel vehicle, the top cover has a swelled portion which is raised upward around the rotating shaft and the relay chamber is formed inside of the swelled portion. With this configuration, the relay chamber is made easily at a high position of the vehicle.

Also, it is preferable that in the straddle-type all terrain vehicle, the air vent system of the carburetors includes an air vent passage connecting carburetors and atmosphere, and the air vent passage has a portion passing through inside of the air cleaner and a tip end opened in atmosphere.

Thereby, the air vent passage can be placed without being restricted by the carburetors and its surrounding parts and its external design appearance can be improved.

Preferably, in the straddle-type four wheel all terrain vehicle, the air cleaner comprises: a body having an intake hole provided in a side face thereof and connecting holes connected to the carburetors; an intake duct connected to an inlet of the intake hole; a guide passage provided inside of the body and at an outlet of the intake hole for guiding air flowing through the intake hole upward; and a filter placed inside of the body such that it separates a portion downstream from the guide passage into a dirty area continuous with the guide passage and a clean area in which the connecting holes are opened, for filtering air flowing through the guide passage to the connecting holes, wherein the intake duct has a tip end opened inside of the top cover and extends obliquely and downward to reach an inlet of the intake hole, the filter is provided in a substantially horizontal direction to allow air flowing through the guide passage to pass through the filter from above and move downward toward the connecting holes, thereby forming a dirty area above the filter and a clean area below the filter with a wall disposed between the guide passage and the clean area, and the connecting holes are provided in a bottom face of the clean area of the body.

With such a configuration, it is possible to provide the straddle-type all terrain vehicle comprising the V-type two cylinder engine mounted thereon that is capable of introducing fresh area containing less dust into the air cleaner and efficiently removing the dust in the air cleaner to supply clean air to the carburetors. Further, the compact and high-performance straddle-type four wheel all terrain vehicle is obtained.

Preferably, in the straddle-type four wheel all terrain vehicle, the air cleaner comprises: a body having an intake hole provided in a side face thereof and connecting holes connected to the carburetors; an intake duct connected to an inlet of the intake hole; a guide passage provided inside of the body and at an outlet of the intake hole for guiding air flowing through the intake hole upward; and a filter placed inside of the body such that it separates a portion downstream from the guide passage into a dirty area continuous with the guide passage and a clean area in which the connecting holes are opened, for filtering air flowing through the guide passage to the connecting holes, wherein the intake duct has a tip end opened inside of the relay chamber and extends obliquely and downward to reach an inlet of the intake hole, the filter is provided in a substantially horizontal direction to allow air flowing through the guide passage to pass the filter from above and move downward toward the connecting holes, thereby forming a dirty area above the filter and a clean area below the filter with a wall disposed between the guide passage and the clean area, and the connecting holes are provided in a bottom face of the clean area of the body.

With such a configuration, it is possible to provide the straddle-type four wheel all terrain vehicle comprising the V-type two cylinder engine mounted thereon that is capable of introducing fresh area containing less dust into the air cleaner and efficiently removing the dust to supply clean air to the carburetors when traveling on rough terrain. Further, the compact and high-performance straddle-type four wheel all terrain vehicle is obtained.

These objects, as well as other objects, features and advantages of the invention will become more apparent to those skilled in the art from the following description with reference to the accompanying drawings.

BRIEF DESCRIPTION OF THE DRAWINGS

FIGS. 14A and 14B are cross-sectional views showing a structure of a vent relay portion of the air cleaner of FIG. 11, wherein FIG. 14A shows a structure of a first vent relay portion and FIG. 14B shows a structure of a second vent relay portion.

DETAILED DESCRIPTION OF THE PREFERRED EMBODIMENTS

Hereinafter, a V-type two-cylinder engine according to an embodiment of the present invention will be described with reference to the accompanying drawings in conjunction with a configuration of a straddle-type four wheel all terrain vehicle on which the V-type two-cylinder engine is mounted.

Figure 1:
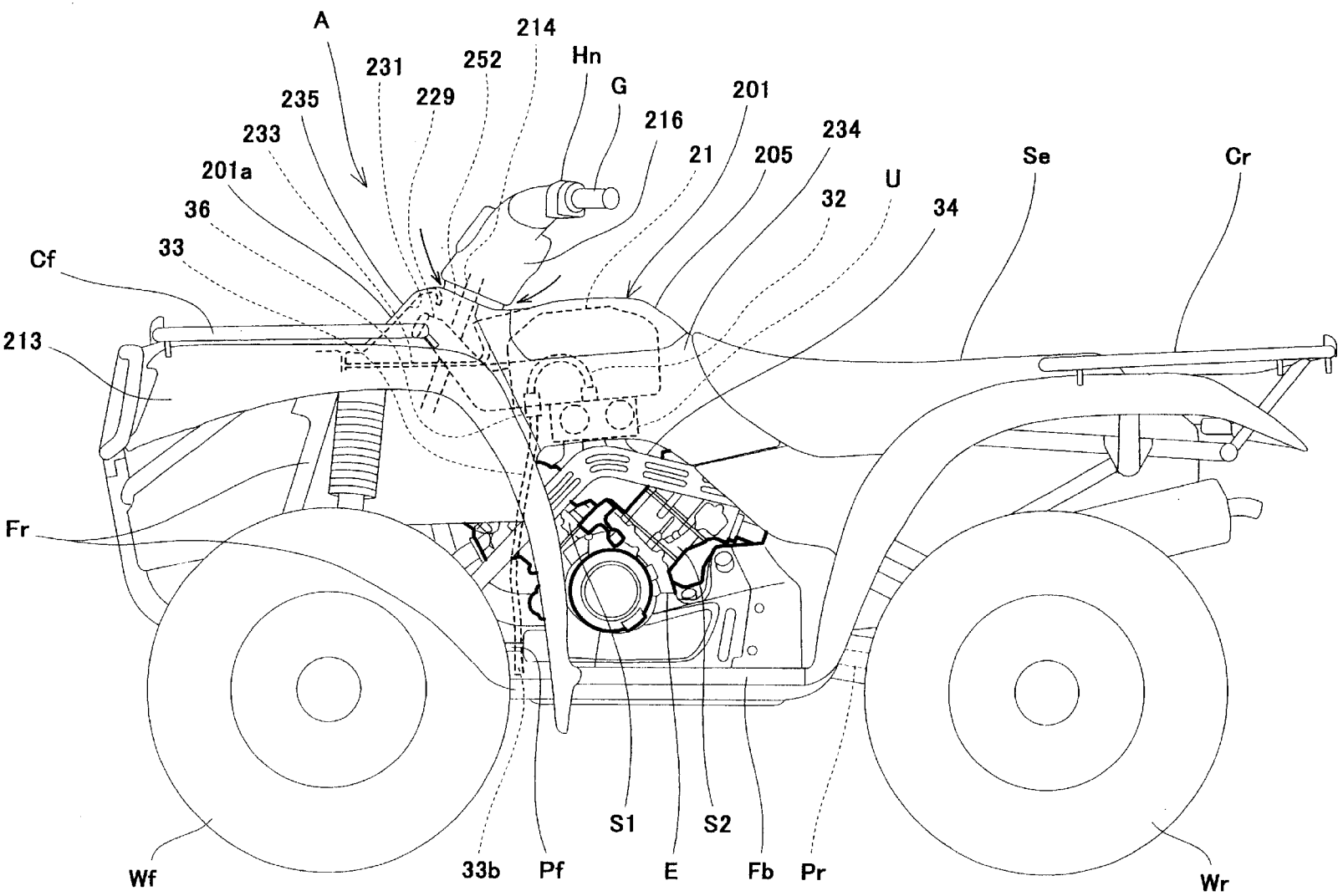
FIG. 1 is a side view showing a straddle-type four wheel all terrain vehicle having a V-type two cylinder engine according to an embodiment of the present invention.

Referring now to FIG. 1, a straddle-type four wheel all terrain vehicle A comprises a steering bar handle Hn rotatably attached to a vehicle body Fr, right and left front wheels Wf, and right and left rear wheels Wr. The straddle-type four wheel all terrain vehicle A further comprises a forward carrier Cf placed forward of the handle Hn, a straddle-type seat Se placed rearward of the handle Hn, an air cleaner cover 205 disposed between the handle Hn and the seat Se, a rearward carrier Cr placed rearward of the seat Se, and foot boards Fb provided on opposite sides situated forward and downward of the seat Se and at positions substantially as high as an axle of the front wheels Wf and the rear wheels Wr. The vehicle A is provided with a V-type two cylinder OHC four cycle engine (hereinafter referred to as a V-type two cylinder engine or V-twin engine) E below the air cleaner cover 205 such that a lower end thereof is substantially as high as the foot boards Fb. Cylinders S1 and S2 of the V-twin engine E are arranged forward and rearward such that they are inclined to make an angle between them in a forward and rearward direction of the vehicle body Fr.

The V-twin engine E is adapted to drive the front wheels Wf or the rear wheels Wr via a torque converter, a transmission gear unit (not shown), a forward output shaft Pf or a rearward output shaft Pr respectively provided in the forward or rearward direction, and a differential unit (not shown).

In so configured straddle-type four wheel all terrain vehicle A, a rider straddles the seat Se, put the rider's feet on the foot boards Fb provided right and left, and grips the handle Hn with both hands to bring the vehicle A into operation.

The V-twin engine mounted on the vehicle A is configured such that the forward and rearward cylinders S1, S2 inclined in V shape seen in a side view are placed as having positional difference between them in a direction of a crank shaft provided in a width direction of the vehicle A.

Figure 9:
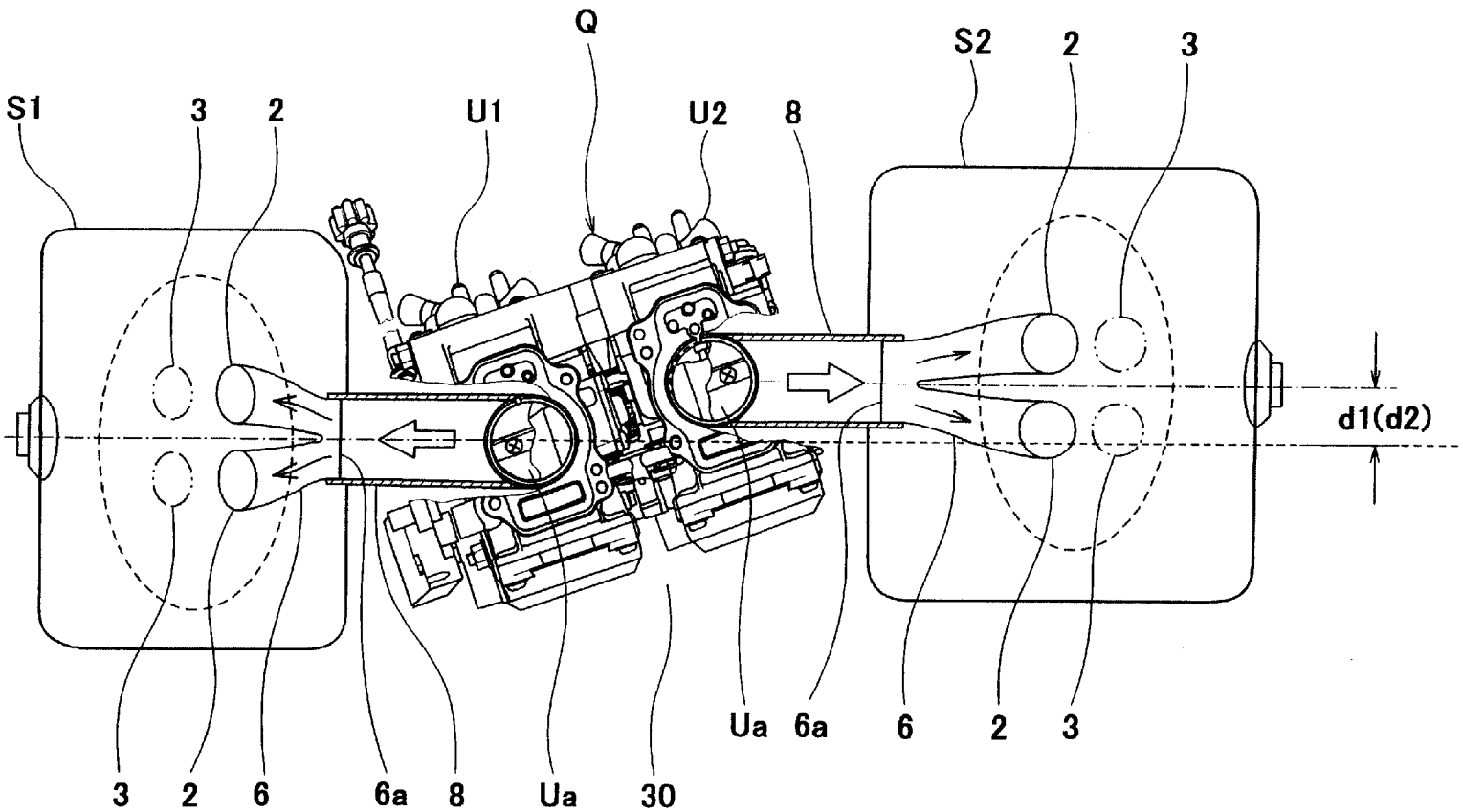
FIG. 9 is a plan view showing planar configuration of an intake equipment, wherein the carburetors are partially cut away and cylinders are schematically shown.
Figure 10:
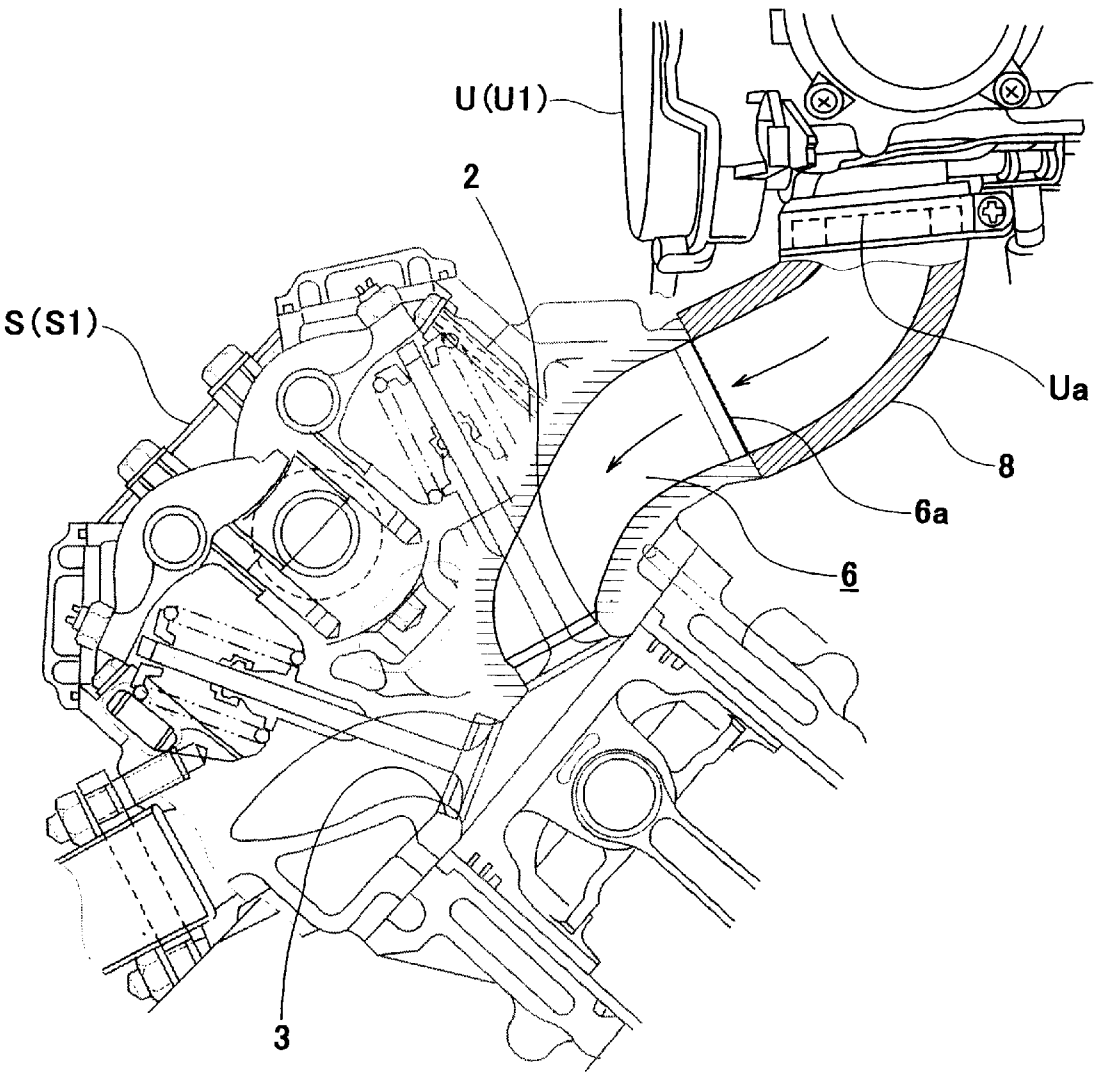
FIG. 10 is a cross-sectional side view showing a side configuration of a carburetor, an intake manifold, and an intake passage of a cylinder, wherein the intake manifold and a cylinder head are partially cut away.

Referring to FIG. 9, two intake valve holes 2 and two exhaust valve holes 3 are formed for each cylinder. These holes are inclined and opened toward the center of the cylinder (combustion chamber). The cylinder S1 (S2) includes an intake passage 6 formed therein. The intake passage 6 connects the intake valve hole 2 and an intake port 6*a* opened in a V-shaped space 30 sandwiched between the cylinders S1, S2. In this embodiment, as shown in FIG. 9, the intake passage 6 is substantially linear (less curved) and has a small length seen in a plan view to reduce intake resistance in the cylinder S1 (S2). The cylinders S1, S2 are substantially identical and difference d1 between the intake ports 6*a* of the cylinders S1, S2 in the direction of the crank shaft seen in a plan view is substantially equal in dimension to difference d2 between the cylinders S1, S2 in the direction of the crank shaft.

Figure 2:
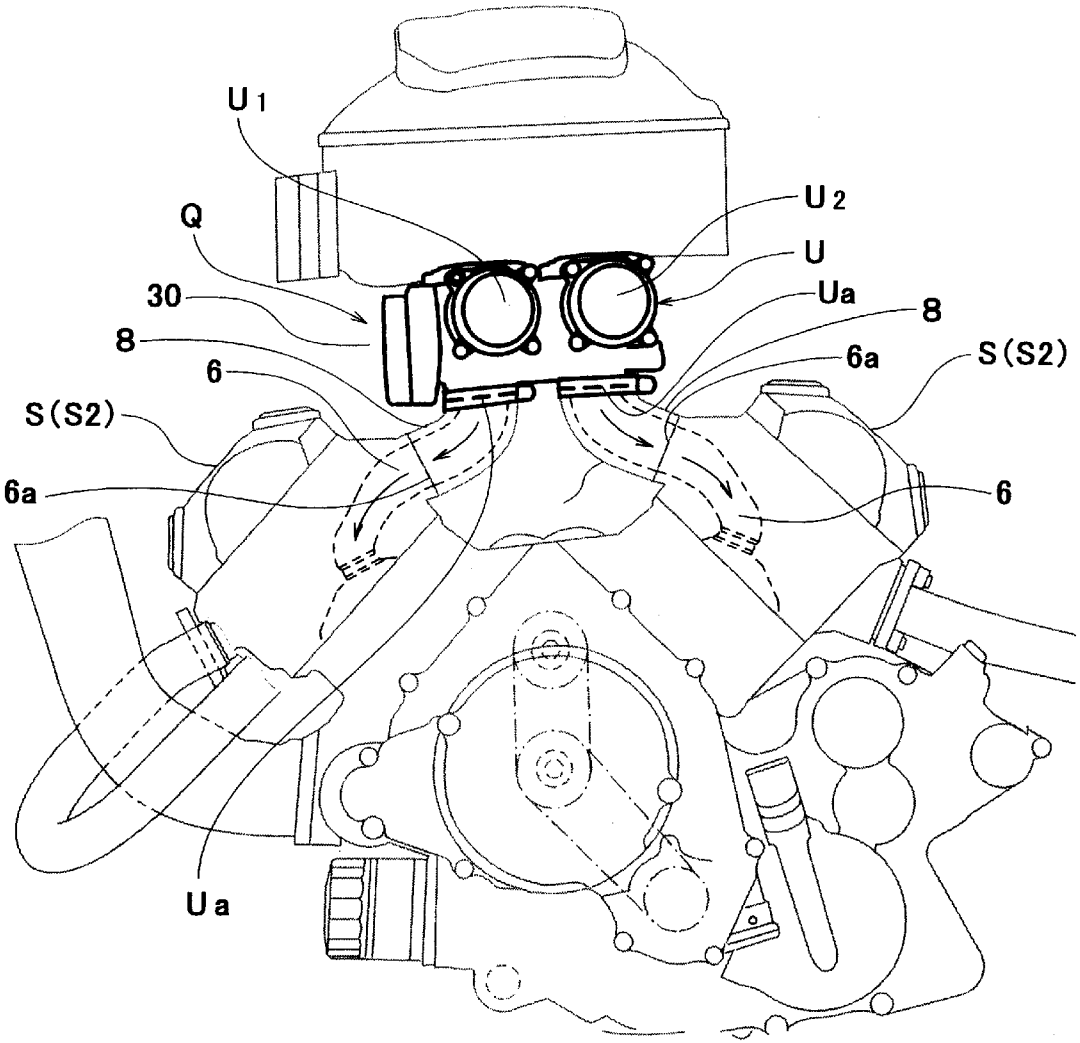
FIG. 2 is an enlarged side view showing an engine including a carburetor unit mounted on the straddle-type four wheel all terrain vehicle of FIG. 1.

Referring to FIG. 2, an intake equipment Q is placed in the V-shaped space 30. Specifically, a carburetor unit U constituting a part of the intake equipment Q and intake manifolds 8 each connecting a venturi bore Ua of each of carburetors U1, U2 of the carburetor unit U and the intake port 6*a* of the cylinder S1(S2) are provided in the V-shaped space 30. In this embodiment, the intake manifolds 8 for the cylinders S1, S2 are physically identical.

Initially, the carburetor unit U of the intake equipment Q will be described.

Figure 3:
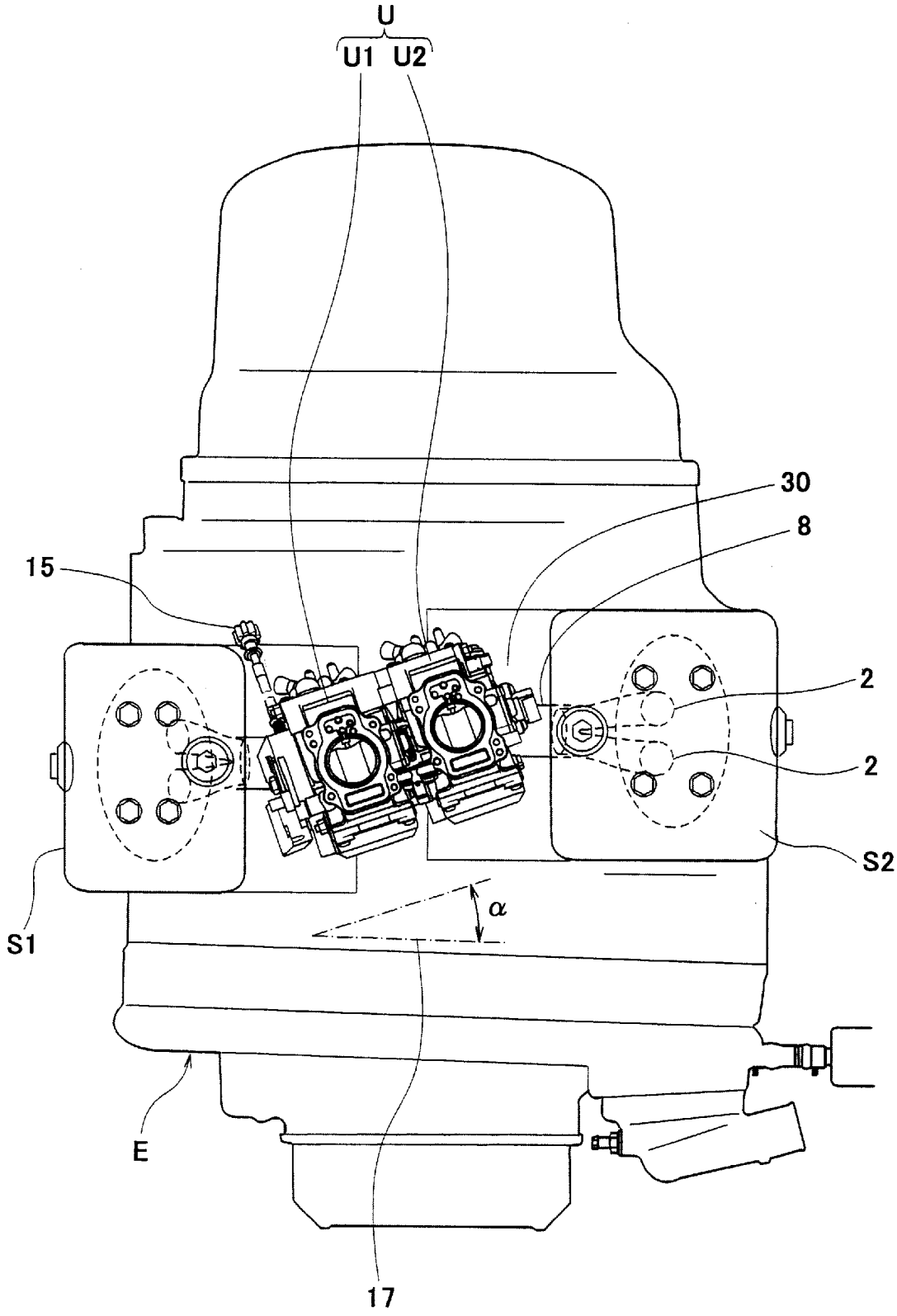
FIG. 3 is a schematic view conceptually showing a planar positional relationship between cylinders and the carburetor unit according to an embodiment.
Figure 4:
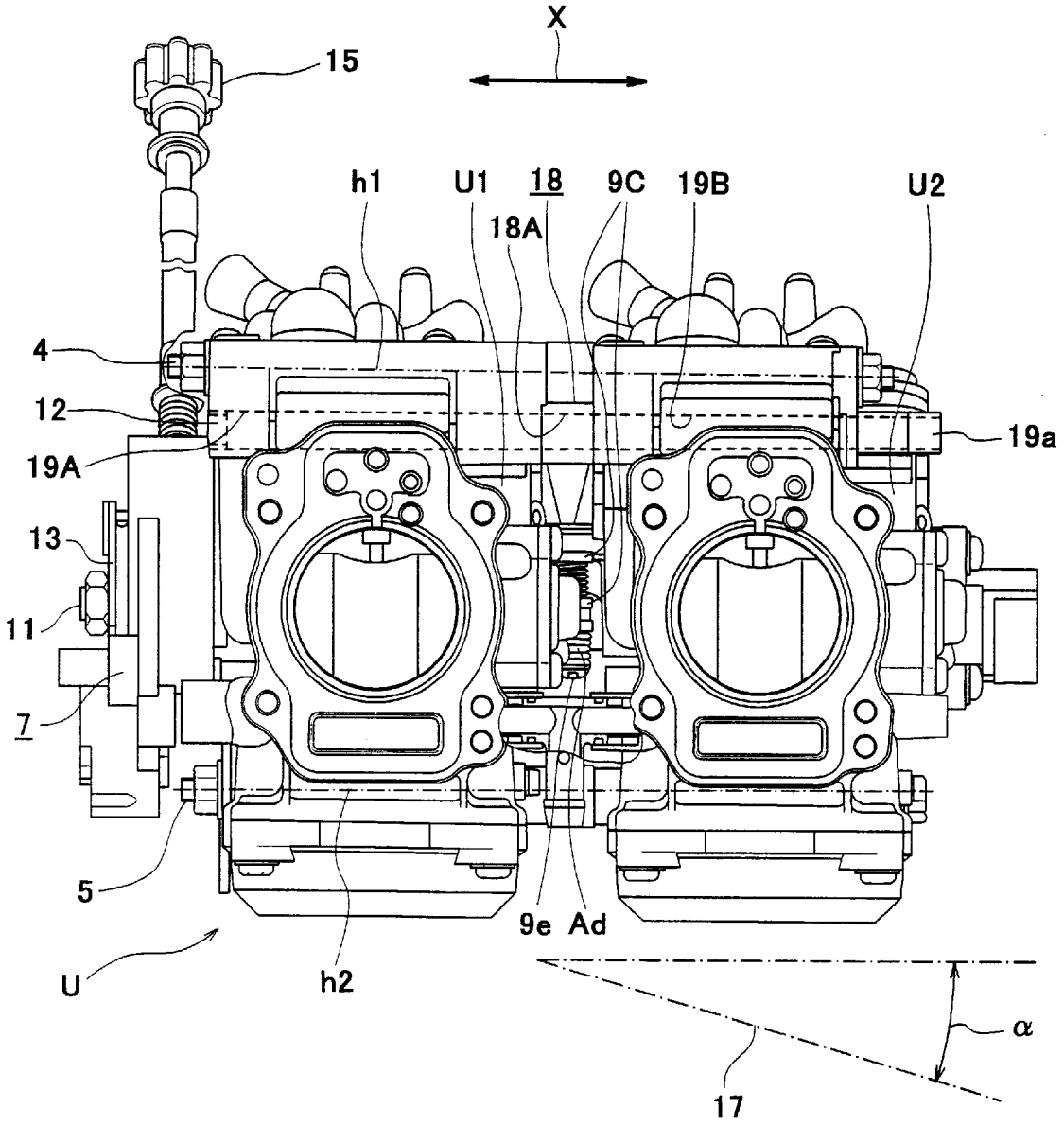
FIG. 4 is an enlarged plan view showing the carburetor unit of the engine of FIG. 1.
Figure 6:
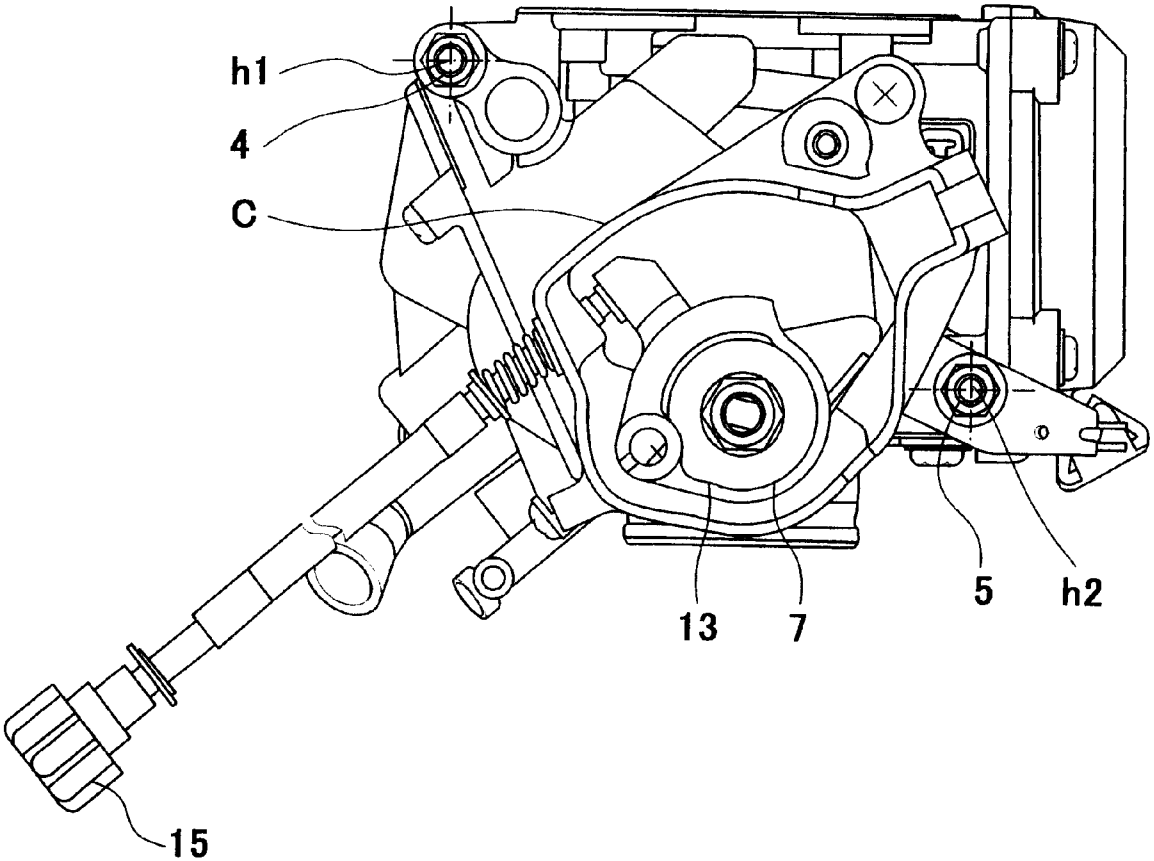
FIG. 6 is a view taken in the direction of the arrows substantially along line of VI—VI in FIG. 5.
Figure 7:
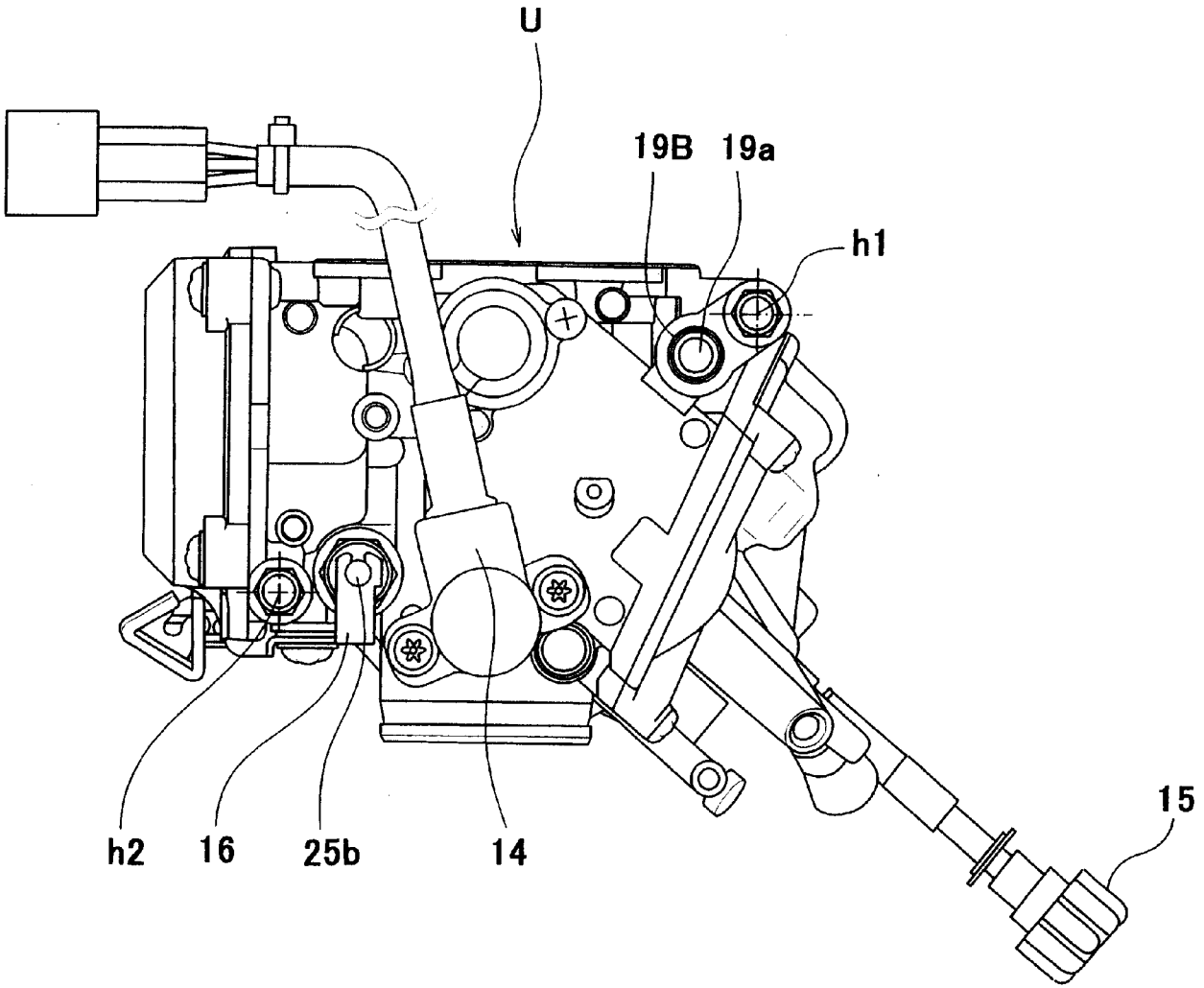
FIG. 7 is a view taken in the direction of the arrows substantially along line of VII—VII in FIG. 5.

As shown in FIGS. 2 to 4, the carburetor unit U is configured such that substantially the same two downdraft carburetors U1, U2 are arranged to be integrally connected. This connection is, as shown in FIG. 4, established by forming common (coaxial) holes (see center lines h1, h2 in a longitudinal direction of the holes of FIG. 4) in the carburetors U1, U2 such that they extend in a direction in which the carburetors U1, U2 are arranged (see a direction indicated by an arrow X of FIG. 4). These holes are, as shown in FIG. 6 or 7, formed such that two holes are on each diagonal line seen in a front view or a rear view of the carburetors U1, U2. The carburetors U1, U2 are secured by means of connecting bolts 4, 5 inserted through these holes to be integrally connected, thereby forming the carburetor unit U.

As shown in FIGS. 4 to 6, and 8, a throttle lever unit 7 is provided at an end face of the carburetor (forward carburetor) U1 that is spaced apart from the carburetor (rearward carburetor) U2 to perform throttling operation of the carburetor U1, U2, i.e., the carburetor unit U. The operation (rotation) of a throttle drum 13 of the throttle lever unit 7 causes butterfly valves 9 of the carburetors U1, U2 of FIG. 8 to be operated simultaneously. Therefore, an operating shaft 11 integrally and rotatably attached to the throttle drum 13 of the throttle lever unit 7 is formed by coaxially extending a rotating shaft 9*a* of the butterfly valve 9 of the carburetor U1 and a rotating shaft 9*b* of the butterfly valve 9 of the carburetor U2 is connected to the rotating shaft 9*a* (operating shaft 11) via a connecting mechanism Ad. The connecting mechanism Ad comprises a spring 9*d* for exerting a force to cause connecting pieces 9*c* formed at a portion where the rotating shafts 9*a*, 9*b* are connected to be closer to each other and an adjustment screw 9*e* acting to cause the connecting pieces 9*c* to be spaced from each other.

Figure 8:
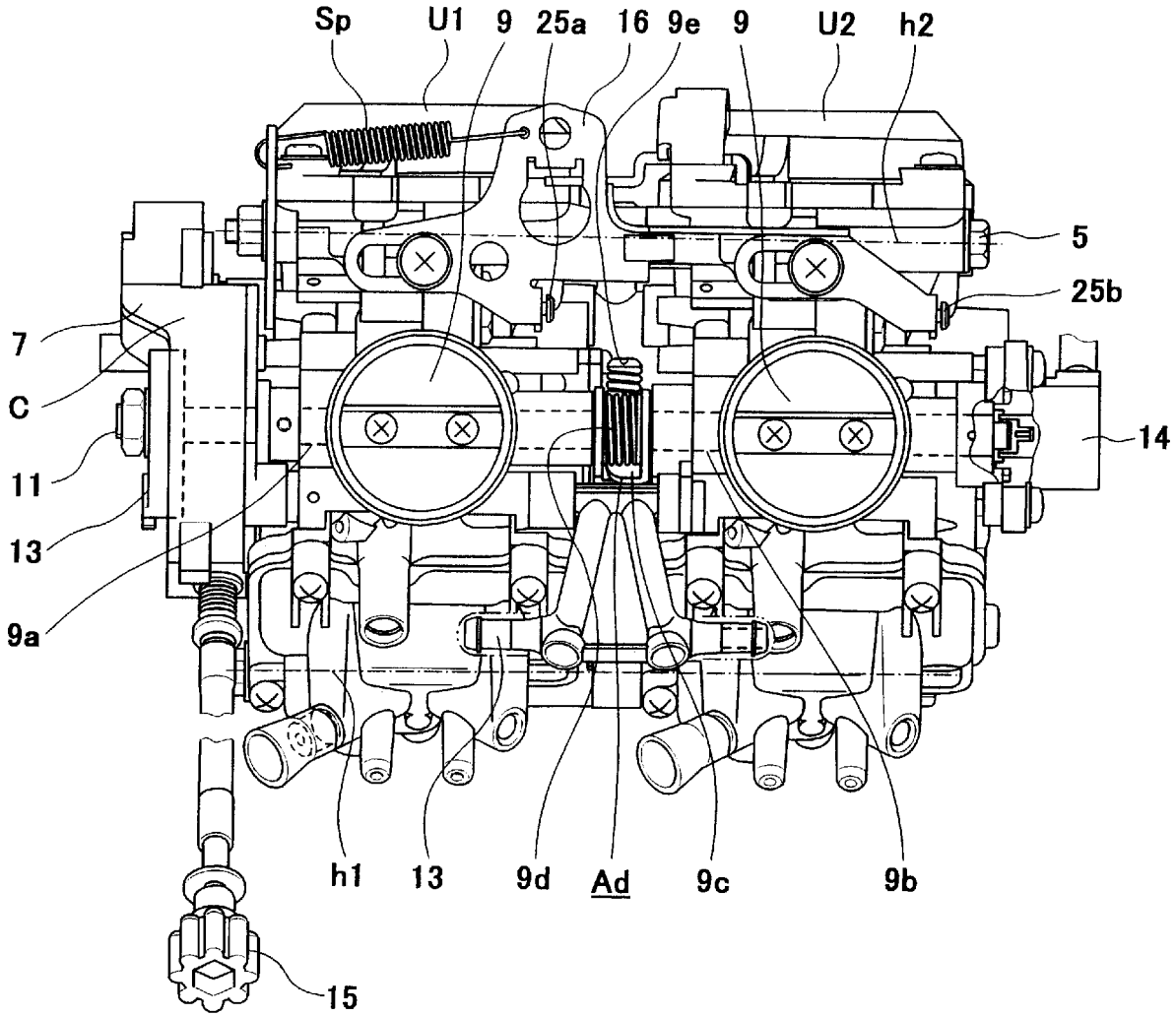
FIG. 8 is a view taken in the direction of the arrows substantially along line of VIII—VIII in FIG. 5.

As shown in FIGS. 4, 6, 8, a tip end portion of a throttle wire having a base end portion attached to a throttle lever (not shown) provided in the vicinity of an operating grip G of the handle Hn (see FIG. 1) is attached to the throttle drum 13. The rotation of the throttle lever of the handle Hn causes the wire to move in a longitudinal direction, thereby rotating the throttle drum 13 shown in FIGS. 4, 6, 8. That is, the butterfly valves 9 of the carburetors U1, U2 can be operated simultaneously and evenly according to the amount of movement of the wire.

As shown in FIG. 4, fuel supply passages 19A, 19B of the carburetors U1, U2 are connected via a connecting member 18 interposed between them and including a fuel passage 18A, a fuel pipe from a fuel tank (not shown) is connected to a supply port 19*a* of the fuel supply passage 19B, and a tip end portion of the fuel supply passage 19A that is apart from the connecting member 18 is closed by a plug member 12, thereby forming a fuel passage of the carburetor unit U.

In FIGS. 3 through 8, reference numeral 14 denotes a throttle sensor, reference numeral 15 denotes a "knob" for adjusting idling which is provided on the throttle lever unit 7, and reference numeral 26 denotes a pipe through which hot water for prevention of icing passes.

As shown in FIGS. 1, 2, 3, the carburetor unit U so configured is sandwiched between the cylinders S1, S2 arranged in V shape and placed in the V-shaped space 30 (side view) obliquely with respect to the cylinders S1, S2 seen in a plan view (FIG. 3). More specifically, the carburetor unit U is placed obliquely such that the venturi bores Ua of the carburetors U1, U2 are situated on extended lines of the intake passages 6 formed in the cylinders S1, S2. In this embodiment, since the intake passages 6 are formed in the direction orthogonal to the crank shaft, as shown in FIG. 9, the carburetor unit U is placed obliquely such that a center line of the intake port 6*a* of the forward cylinder S1 (center line extending in the direction orthogonal to the crank shaft) is substantially the same as a center line of the venturi bore Ua of the corresponding carburetor U1 (center line extending in the direction orthogonal to the crank shaft) and a center line of the intake port 6*a* of the rearward cylinder S2 (center line extending in the direction orthogonal to the crank shaft) is substantially the same as a center line of the venturi bore Ua of the corresponding carburetor U2 (center line extending in the direction orthogonal to the crank shaft).

Figure 5:
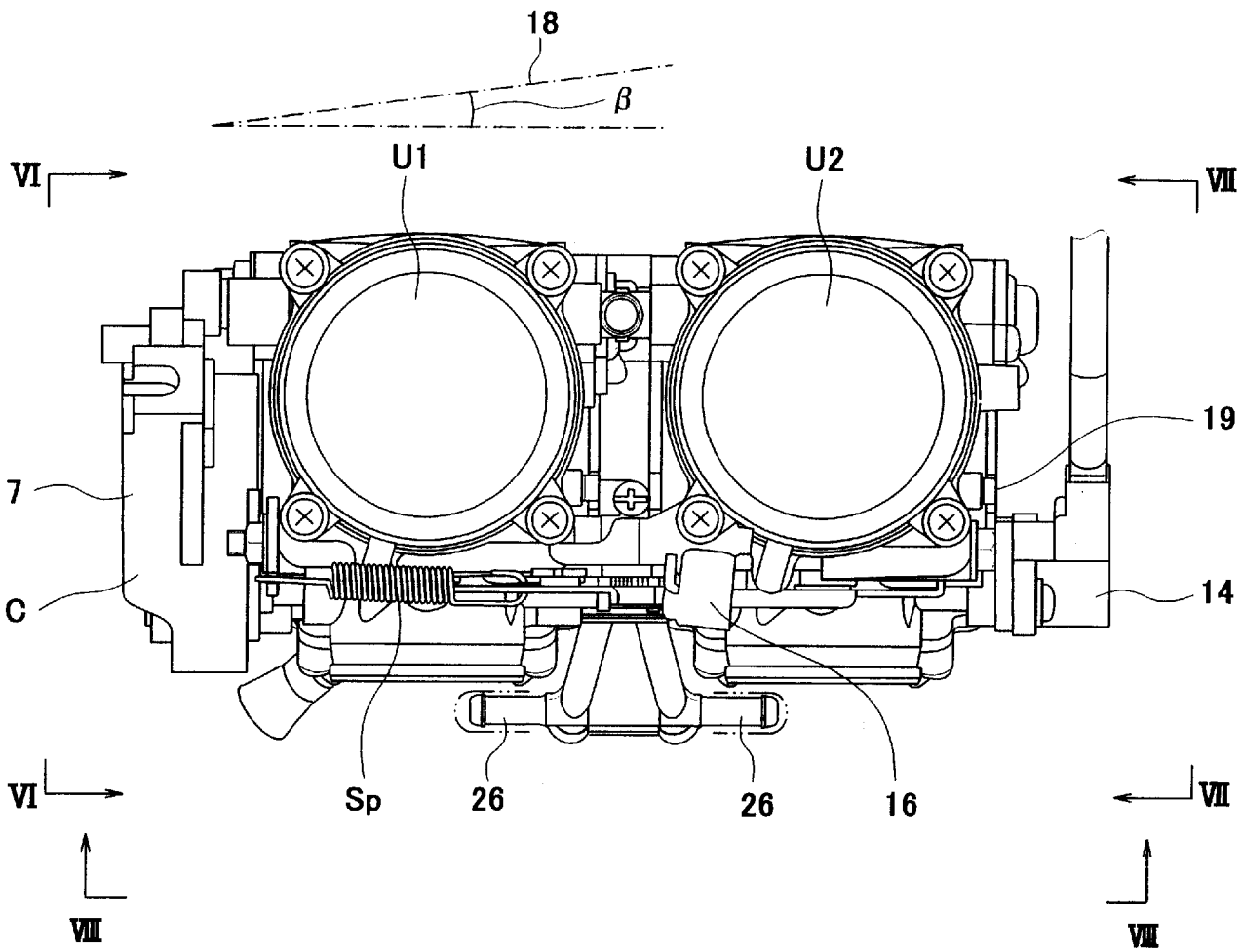
FIG. 5 is an enlarged side view showing the carburetor unit of FIG. 4.

As mentioned later, in this embodiment, the carburetor unit U is placed as being inclined with respect to a base line (in this embodiment horizontal line) 18 extending in a forward and rearward direction of the engine (see an angle of FIG. 5) seen in a side view (see FIG. 5).

The carburetor unit U so configured functions as follows.

The substantially same two carburetors U1, U2 are assembled into one unit by inserting the connecting bolts 4, 5 through the holes (see the center lines h1, h2) formed on each diagonal line seen in a front view or a rear view and by fastening nuts N at tip end portions of the bolts. In this connection, the rotating shafts 9*b* of the butterfly valves 9 of the carburetors U1, U2 are connected via the connecting mechanism Ad. In this connection, the connecting member 18 including the fuel passage 18A is interposed between the fuel supply passages 19A, 19B of the carburetors U1, U2. The end portion of the fuel supply passage 19A of the carburetor U1 that is apart from the connecting member 18 is closed by the plug member 12.

Subsequently, choke operating members 25*a*, 25*b* of the carburetors U1, U2 are connected by means of a connecting member 16, which is biased by spring Sp so that choke members are in an inoperable condition while they are not operated by an operator (see FIG. 8). The throttle lever unit 7 is connected to the end portion of the carburetor U1 that is apart from the carburetor U2 so that the throttle drum 13 is attached to the operating shaft 11.

The end portion of the throttle wire for throttle operation is engaged with the throttle drum 13 of the throttle lever unit 7, which enables the throttle operation by the throttle lever. In this embodiment, the throttle lever unit 7 is covered with a cover C to prevent the entry of trashes.

Thus assembled carburetor unit U is placed obliquely in the space 30 between the cylinders S1, S2 arranged in V shape. Specifically, as shown in FIG. 3, 9 (plan view), the carburetor unit U is placed as being inclined with respect to the base line 17 in the forward and rearward direction of the engine (see the angle of FIG. 4) in such a manner that the center line of the intake port 6*a* of the cylinder S1 substantially matches the center line of the venturi bore Ua of the corresponding carburetor U1 so that the distance between the venturi bore Ua of the carburetor U1 and the intake port 6*a* of the cylinder S1 is equal to the distance between the venturi bore Ua of the carburetor U2 and the intake port 6*a* of the cylinder S2 and the intake manifolds 8 and the like connecting these parts are less curved. In this embodiment, the cylinders S1, S2 are provided on a crankcase such that they are inclined forward and rearward at different angles with respect to a vertical line. Therefore, the carburetor unit U is placed as being inclined with respect to the base line (horizontal line) 18 in the forward and rearward direction of the engine seen in a side view (see an angle of FIG. 5) such that the distance between the carburetor U1 and the intake port 6*a* of the cylinder S1 is equal to the distance between the carburetor U2 and the intake port 6*a* of the cylinder S2 as shown in FIGS. 2, 5.

While the carburetor unit is placed obliquely seen in the side view, it may be placed obliquely seen in the front view according to placement of the cylinders.

According to the V-twin engine of this embodiment, the distance between the intake port of one cylinder and the venturi bore of the corresponding carburetor can be made equal to the distance between the intake port of the other cylinder and the venturi bore of the corresponding carburetor and curvature of the intake manifolds connecting these parts can be minimized. Therefore, an intake equipment having a low intake resistance is obtained. Moreover, since the structure of the intake equipment can be simplified, the number of parts and the man-hour assemblies can be reduced, and the intake equipment can be manufactured at a low cost.

Subsequently, an embodiment in which the V-twin is provided with a suitable air cleaner and an embodiment of an "straddle-type four wheel all terrain vehicle" adapted to supply fresh air containing less dust will be described with reference to FIGS. 1, 11, 12.

As shown in FIG. 1, the straddle-type four wheel all terrain vehicle A is provided with a top cover 235, a side cover 234, and an air cleaner cover 205 (hereinafter these covers are referred to as a "cover 201") such that they cover an upper side from a front portion of the vehicle body to a front end of the seat Se. In this embodiment, the top cover 235 is formed integrally with a front fender 213 covering the front wheels Wf. A portion 201*a* (hereinafter referred to as a swelled portion) of the cover 201 around the rotating shaft 214 of the handle Hn is raised from its right and left sides to its front and has an opening 252 in a substantially top portion, through which the rotating shaft 214 penetrates. There is a predetermined clearance formed between the opening 252 and the rotating shaft 214. The opening 252 is covered with a handle cover 216 situated above.

A plate-shaped partition member 233 is provided for defining a lower portion and a rear portion of an inner space of the swelled portion 201*a*, thereby forming a relay chamber 231 corresponding to a closed space inside of the raised portion 201*a*. A portion of the partition member 233 forming a bottom wall of the relay chamber 231 includes an insertion hole (not shown) through which the rotating shaft 214 is inserted. It is desirable to minimize a clearance between the insertion hole and the rotating shaft 214 to prevent the inflow of air. The partition member 233 is formed of a rubber plate, for example.

An intake duct 229 of the air cleaner 21 is provided such that it penetrates through the partition member 233 and a tip end thereof is opened in the inner space of the relay chamber 231.

Figure 11:
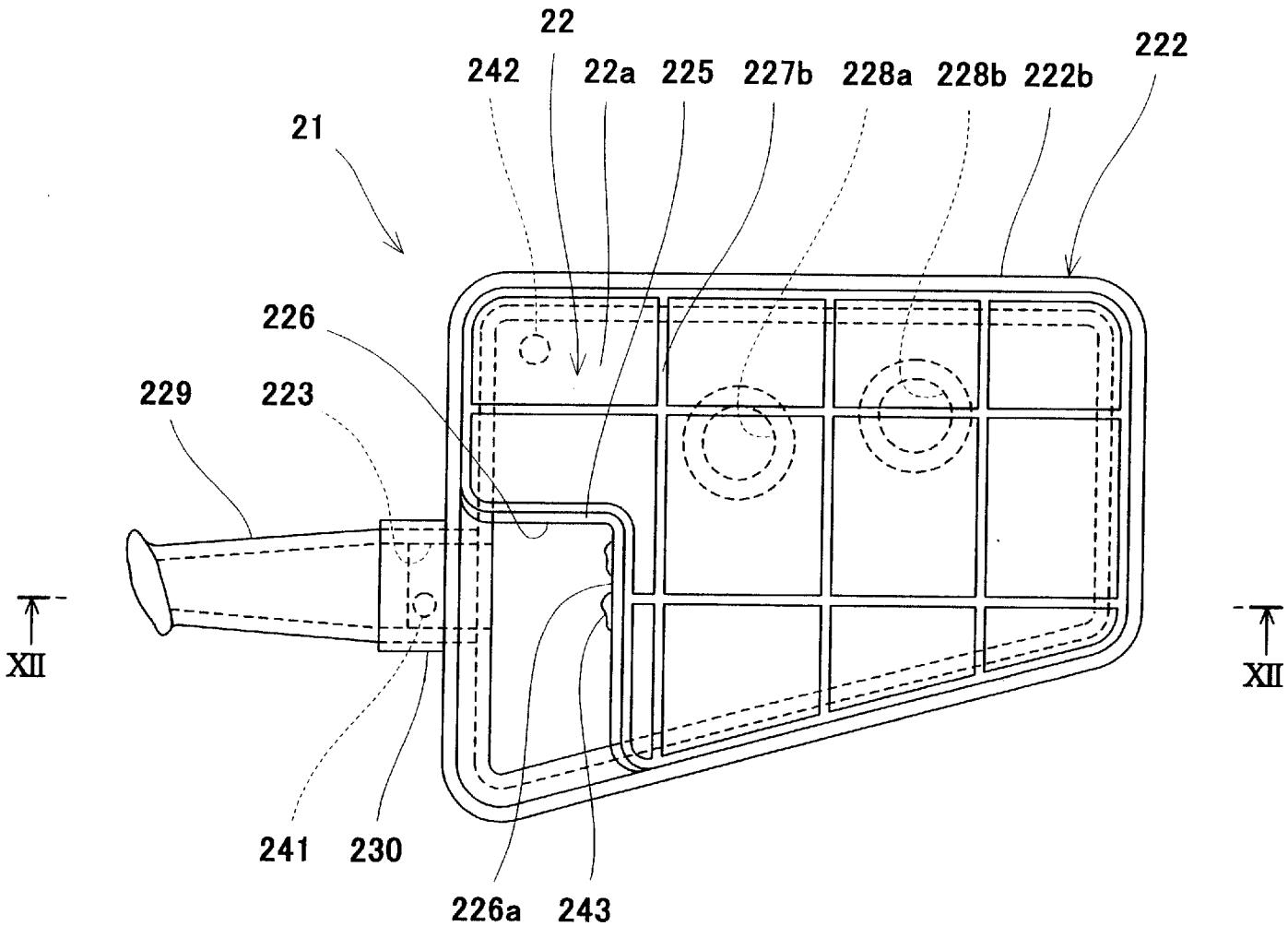
FIG. 11 is a plan view showing a detailed structure of the air cleaner of FIG. 1.
Figure 12:
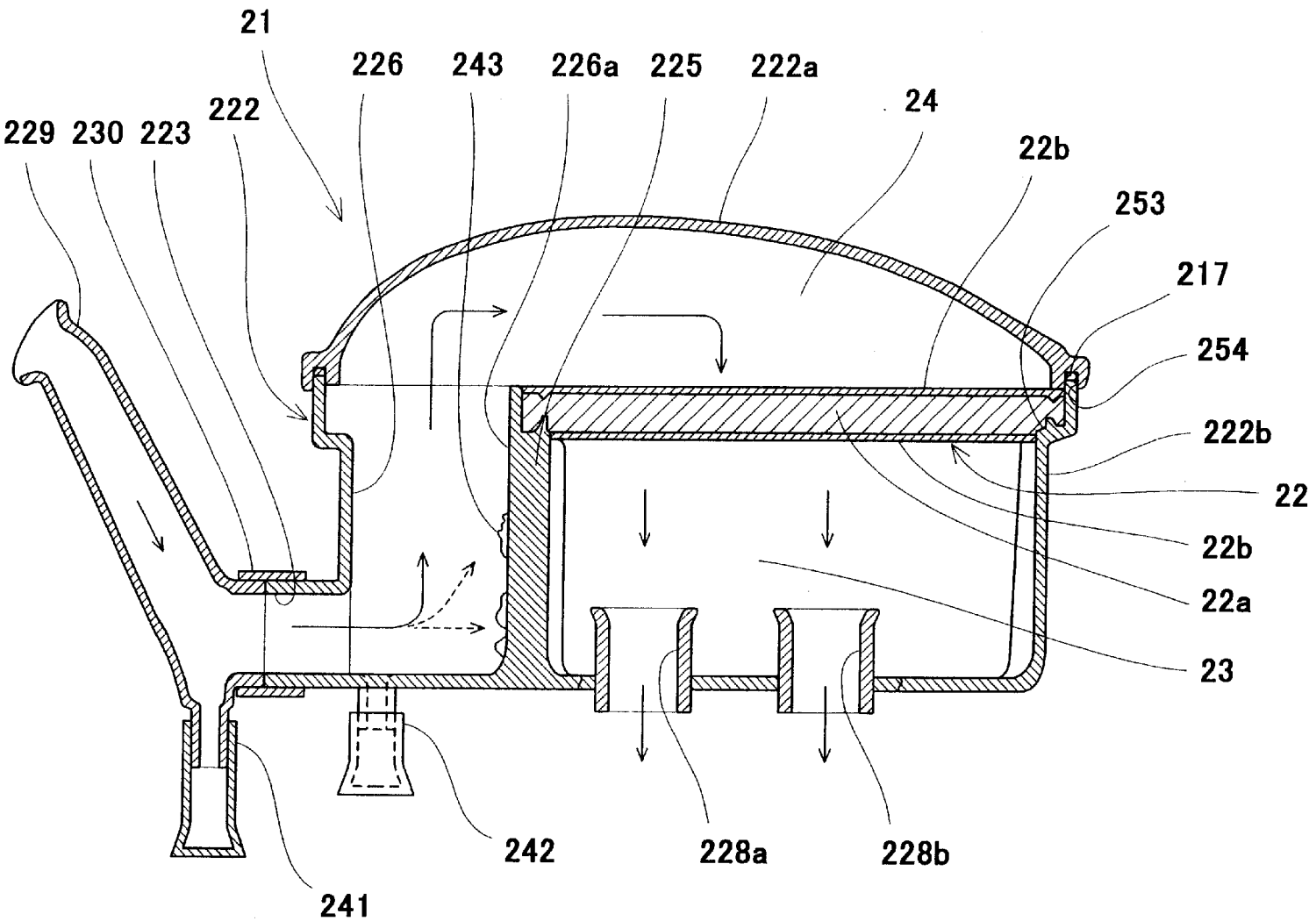
FIG. 12 is a cross-sectional side view taken in the direction of the arrows substantially along line of XII—XII in FIG. 11.

FIG. 11 is a plan view showing a detailed structure of the air cleaner with a lid portion thereof detached and FIG. 12 is a cross-sectional side view taken in the direction of the arrows substantially along line of XVI—XVI in FIG. 11. Referring to FIGS. 11, 12, the air cleaner 21 includes a body 222. The body 222 is constituted by a box-shaped filter accommodating portion 222*b* having an opened upper end portion and a lid portion 222*a* put on the upper end of the filter accommodating portion 222*b*. The lid portion 222*a* is curved such that a peripheral portion thereof is protruded downward and provided with a groove 254, into which the upper end portion of the filter accommodating portion 222*b* is fitted. The upper end portion of the filter accommodating portion 222*b* is fitted into the groove 254 of the lid portion 222*a* through a seal member 217, thereby forming the body 222. The lid portion 222*a* is removably attached to the filter accommodating portion 222*b* by means of a fixing member (not shown).

The filter accommodating portion 222*b* includes an intake hole 223 formed in a lower end portion of a side face thereof. An intake duct 229 is connected to an inlet of the intake hole 223 by means of a connecting member 230. The intake duct 229 extends obliquely and downward from a tip end thereof and reaches the inlet of the intake hole 223 and has a passage section area gradually increased from the tip end to a base end thereof. The intake duct 229 is provided with a drain 241 at a base end portion thereof. The tip end of the intake duct 229 is opened in the relay chamber 231 formed around the rotating shaft 214 of the handle Hn as described above (see FIG. 1).

The filter accommodating portion 222*b* includes a separating wall 225 vertically provided on a bottom face inside thereof such that the separating wall 225 surrounds an outlet of the intake hole 223 seen in a plan view, thereby forming a guide passage 226.

An upper end of the separating wall 225 is slightly lower than an upper end of the filter accommodating portion 222*b*. Step portions 253 are respectively formed inward of the upper end portion of the filter accommodating portion 222*b* and at the upper end portion of the separating wall 225 that is apart from the guide passage. A flat-plate shaped filter (filter element) 22 is fitted in the step portion 235. The filter 22 is held by the step portions 235 and peripheral end faces of the lid member 222*a*. As a consequence, the filter 22 placed horizontally in the step portion separates a portion inside of the body 222 and downward from the guide passage 226 into a dirty area 24 situated above the filter 22 and a clean area 23 situated below the filter 22. The clean area 23 is situated laterally of the guide passage 226 and isolated from the guide passage by the separating wall 225 disposed between the guide passage 226 and the clean area 23. The filter 22 is structured such that a flat-plate filter member 22*a* is sandwiched between a pair of grid reinforcement members 22*b*. Although a wet filter is employed as the filter 22, a dry filter may be employed.

The clean area 23 includes a pair of connecting holes 228*a*, 228*b* formed in a bottom face thereof. The connecting holes 228*a*, 228*b* are connected to the carburetor unit U (see FIG. 1) as described above. As clearly shown in FIG. 11, the drain 242 is provided in a front portion (left in FIG. 11) of the bottom face of the clean area 23, to temporarily store water and the like accumulated inside.

As shown in FIG. 1, the air cleaner 21 is obliquely attached to the vehicle body such that a portion closer to the intake duct 229 is slightly lower.

Subsequently, function of the air cleaner 21 so configured and arranged will be described. Referring to FIGS. 1, 11, 12, when the V-twin engine E starts, fresh area passes through the clearance between the opening 252 of the cover 201 and the rotating shaft 214 of the handle Hn and flows into the relay chamber 231, where the air is introduced into the intake duct 229 of the air cleaner 21. The introduced air passes through the intake hole 223 and flows into the body 222, at which time, the air collides with the wall face 226*a* of the guide passage 226 that is opposite to the outlet of the intake hole 223. Thereby, the water, mud or the like 243 contained in the air is attached to the wall face 226*a* or dropped downward. The water attached to the wall face 226*a* moves on the wall face 226*a*, the bottom face of the guide passage 226, and the bottom face of the intake hole 223 and is accumulated in the drain 241. Thereby, the water, mud, or the like 243 is removed from the air introduced into the air cleaner 21. Then, the air, from which the water, mud or the like 243 has been removed, moves upward through the guide passage 226 and flows into the dirty area 24 from an upper end thereof. The air flowing into the dirty area 24 flows in the horizontal direction and then flows downward to pass through the filter 22. At this time, the dust in the air is removed by the filter 22. Thereby, the air introduced into the air cleaner 21 is purified. Then, the purified air passes through the clean area 23 and is supplied to the carburetor unit U through the connecting holes 228*a*, 228*b*. In some cases, oil, gasoline, or the like moves from the carburetor unit U toward the inside of the air cleaner 21, in which cases, the oil, the gasoline, or the like moves on the bottom face 23 of the clean area 23 and is accumulated in the drain 242.

For maintenance of the air cleaner 21, the air cleaner cover 205 of the vehicle body is first opened and the fixing member of the body 222 of the air cleaner 21 is then removed to allow the lid portion 22*a* to be detached. Thereafter, the air cleaner 21 is checked and cleaned. If necessary, operator's hands, tools, and the like are put in from a direction of the upper end of the guide passage 226 to remove the mud or the like 233 attached to the wall face 226*a*. Further, plugs of the drains 241, 242 are detached therefrom and the accumulated water, oil, gasoline, and the like are discharged.

Thus, in this embodiment, since the water, mud, or the like 243 contained in the air is removed by the wall face 226*a* of the guide passage.

Since the opening 252 through which the fresh area is introduced is provided at an upper and central portion of the vehicle body where the fresh area is relatively clean, the water, mud, or the like hardly enters the opening 252. As a consequence, the attachment of them to the filter 22 can be further reduced. Besides, the opening 252 is formed around the rotating shaft 214 of the handle Hn and situated just before the rider. Therefore, if the opening 252 is clogged with foreign substances, they can be found immediately and removed. Further, since the opening 252 is covered with the handle cover 215 situated above, the entry of the water or mud from above can be avoided with a simple configuration and the portion in the vicinity of the opening 252 has an excellent external design appearance.

Since the V-twin engine E is mounted on the vehicle A and the carburetor unit U is placed in the space sandwiched between the forward and rearward cylinders S1, S2, it is possible to place the air cleaner 21 between the rotating shaft 214 of the handle Hn and the seat Se. Thereby, the structure in which the fresh area is introduced through the opening 252 of the cover 201 to the air cleaner 21 is easily realized.

Subsequently, an embodiment in which the carburetors U1, U2 of the V-twin engine has an air vent system will be described with reference to FIGS. 1, 13, 14.

Figure 13:
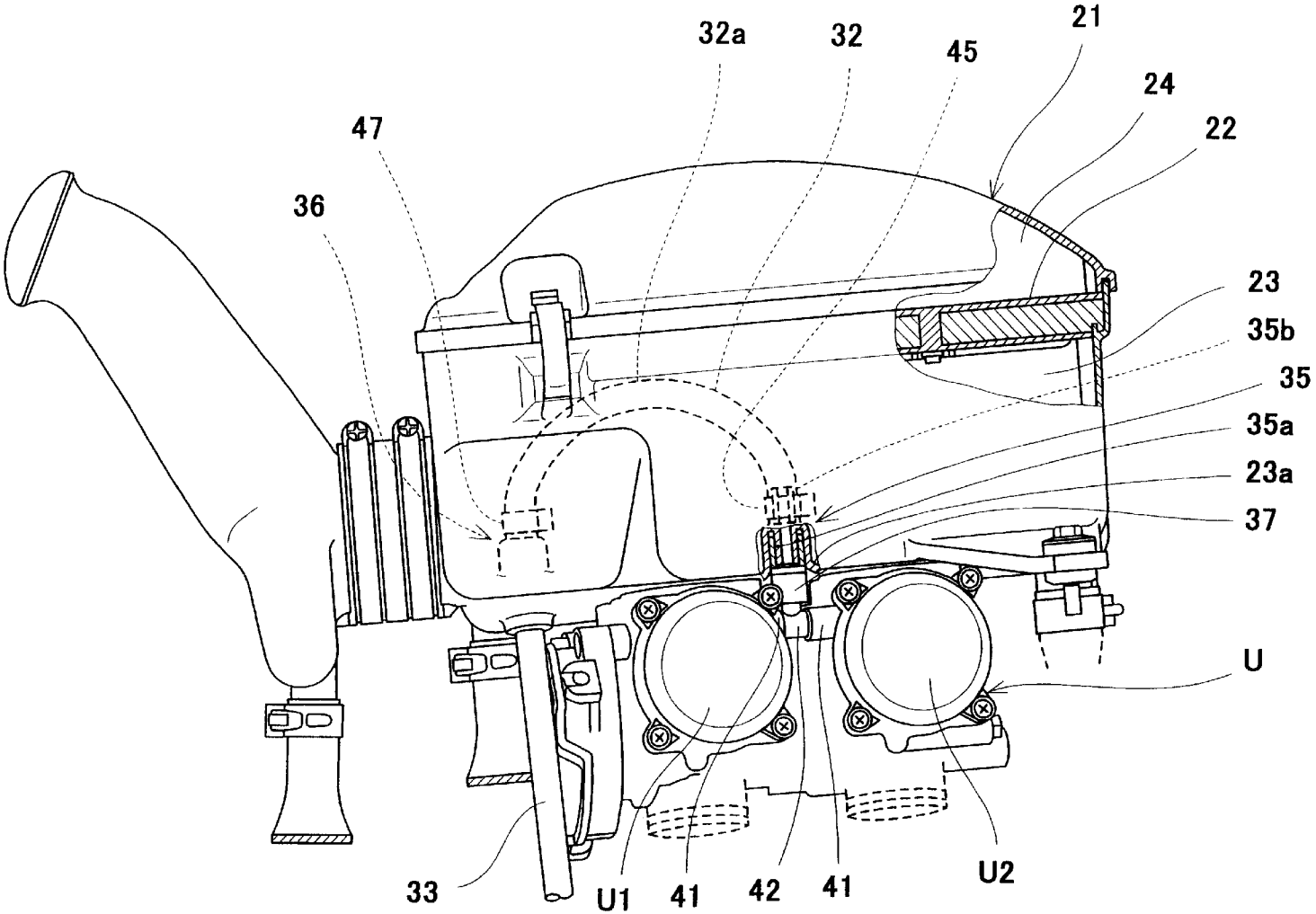
FIG. 13 is a left side view showing a part of a cross section of an enlarged air vent system of the carburetor unit of FIG. 1.

Referring to FIG. 13, each of the forward and rearward carburetors U1, U2 constituting the carburetor unit U comprises a float chamber (not shown), an air vent hole 41, and a venturi bore (not shown). Each of the float chamber is provided at the middle of a fuel supply passage in each of the carburetors U1, U2 that is formed to introduce the fuel from an external fuel tank (not shown) to the venturi bore and has the air vent hole 41 opened in an upper portion thereof and communicating with atmosphere. Thereby, the fuel supplied from the fuel tank is temporarily accumulated in the float chamber and an atmospheric pressure is applied on a liquid face of the accumulated fuel. A base end of the venturi bore is connected to the air cleaner 21 to allow the air supplied from the air cleaner 21 to flow downward. Such downward flow of the air in the venturi bore causes the fuel to be suctioned into the venturi bore from the float chamber and atomized, thereby generating fuel-air mixture.

The air vent of the carburetors U1, U2 of the carburetor unit U is constituted by an inner air passage and an outer air passage. The air vent is constituted by the air vent holes 41 provided for the respective carburetors U1, U2 and first and second air vent tubes 32, 33 shared by the carburetors U1, U2. The air vent hole 41 has a base end (end closer to the float chamber) opened at a position higher than a position of the liquid face of the fuel in the float chamber and a tip end opened in a tip end face of a portion projected in the space between the forward and rearward carburetors U1, U2 as shown in FIG. 13.

The interior of the air cleaner 21 is horizontally separated by the filter 22 placed horizontally in the step portion, thereby forming the dirty area 24 above the filter 22 and the clean area 23 below the filter 22. A first vent relay portion 35 and a second vent relay portion (an exist of the air cleaner 21) 36 are formed on a floor wall 23*a* of the air cleaner 21 constituting a lower wall of the clean area 23 to enable communication between inside and outside of the floor wall 23*a*.

Figure 14B:
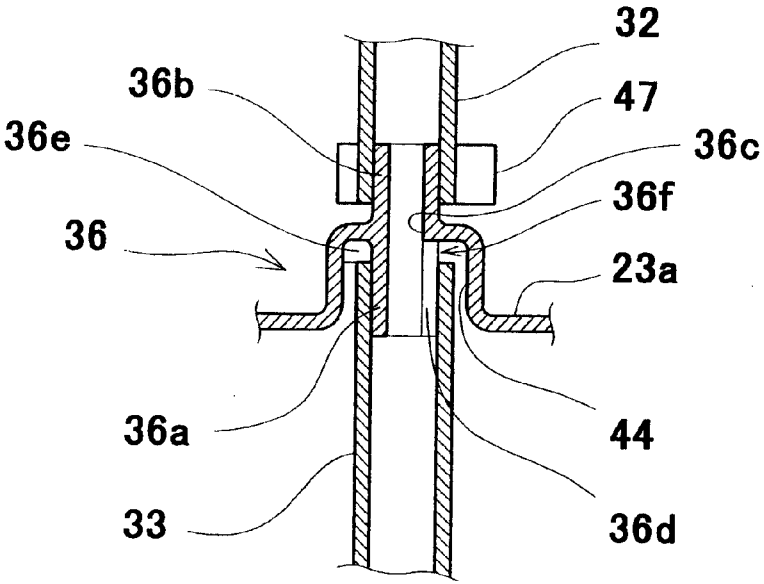
Figure 14A:
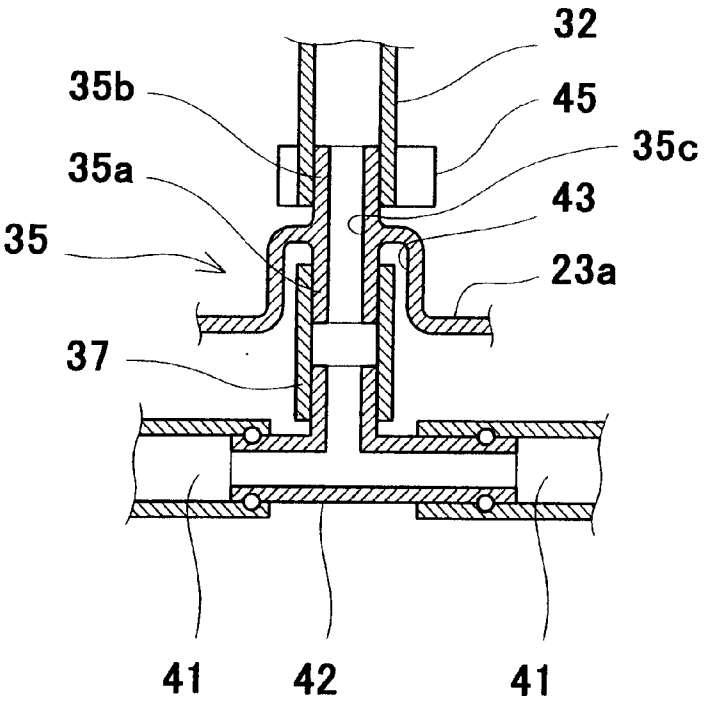

More specifically, as shown in FIGS. 13, 14A, the floor wall 23*a* of the air cleaner 21 that is situated in an upper portion in the middle of the carburetor unit U, that is, in the upper portion between the forward and rearward carburetor units U1, U2 is recessed upward to form a first concave portion 43. The concave portion 43 includes a through hole 35*c* formed in a bottom portion thereof. A cylindrical outer connecting end 35*a* and a cylindrical inner connecting end 35*b* respectively extend downward and upward from the bottom portion of the concave portion 43 such that inner holes of the respective ends 35*a*, 35*b* are continuous with the through hole 35*c*. The through hole 35*c*, the outer connecting end 35*a*, and the inner connecting end 35*b* constitute the first vent relay portion 35.

An upper end portion of a rubber connecting tube 37 is fitted to the outer connecting end 35*a* of the first vent relay portion 35, and a tip end of the air vent hole 41 of each of the forward and rearward carburetors U1, U2 is connected to a lower end of the connecting tube 37 via a resinous T-joint 42. One end portion of the first air vent tube 32 is fitted to the inner connecting end 35*b* and fixed by means of the clamp 45.

As shown in FIGS. 13, 14B, the floor wall 23*a* is recessed upward to form a second concave portion 44 in the front portion of the floor wall 23*a* of the air cleaner 21. A through hole 36*c* is formed in the bottom portion of the concave portion 44. A cylindrical outer connecting end 36*a* and a cylindrical inner connecting end 36*b* respectively extend downward and upward from the bottom portion of the concave portion 44 such that inner holes of the respective ends 36*a*, 36*b* are continuous with the through hole 36*c*. A slit 36*d* is formed in a peripheral wall of the outer connecting end 36*a* over the entire length thereof in an axial direction thereof. A rib 36*e* is formed between a base end portion on the outer periphery of the outer connecting end 36*a* where the slit 36*d* is not formed and an inner face of the concave portion 44. The through hole 36*c*, the outer connecting end 36*a*, the inner connecting end 36*b*, and the rib 36*e* constitute the second vent relay portion 36.

The other end portion of the first air vent tube 32 is fitted to the inner connecting end 36*b* of the second vent relay portion 36 and fixed by means of the clamp 47. The first air vent tube 32 pass through the clean area 23 of the air cleaner 21 such that the tube 32 is circularly curved and its middle portion is higher than its end portions. A base end portion of the second air vent tube 33 is fitted to the outer connecting end 36*a* of the second vent relay portion 36. The second air vent tube 33 is fitted to the outer connecting end 36*a* such that the base end thereof abuts against a lower end of the rib 36*e*. Thereby, a base end portion 36*f* of the slit 36*d* of the outer connecting end 36*a* is opened and constitutes an intermediate air vent hole.

The second air vent tube 33 extends downward from the outer connecting end 36*a* of the second vent relay portion 36 in a portion forward of the V-twin engine E such that it does not make contact with engine parts such as the cylinders S1, S2 of the engine E and an exhaust pipe 34 (see FIG. 1). A tip end of the second air vent tube 33 is opened in atmosphere and constitutes a tip end air vent hole 33*b* (see FIG. 1).

The air vent holes 41 of the forward and rearward carburetors U1, U2 and the joint 42 constitute the inner air passage of the air vent system. The connecting tube 37, the first vent relay portion 35, the first air vent tube 32, and the second vent relay portion 36 constitute a first outer air passage and the second air vent tube 33 constitutes a second outer air passage of the air vent system.

Since the intermediate air vent hole 36*f* is formed in the base portion of the outer connecting end 36*a* of the second vent relay portion 36 such that it is situated in a recessed portion of the lower face of the air cleaner 21, it is hardly affected by mud, water, dust, and the like during traveling of the vehicle.

Subsequently, function of the air vent system of the carburetor unit so configured will be described.

As shown in FIGS. 1, 13, the float chamber of each of the carburetors U1, U2 communicates with atmosphere via the inner air passage such as the air vent hole 41, and the outer air passages such as the first and second vent tubes 32, 33, and in the intermediate air vent hole 36*f* and the tip end air vent hole 33*b*. Thereby, the atmospheric pressure is applied on the liquid face of the fuel temporarily accumulated in the float chamber. As a consequence, the fuel and the air are stably mixed in the venturi bore in a desired condition. In a case where the straddle-type four wheel all terrain vehicle A on which the engine having such an air vent system is mounted is traveling on rough terrain, if the fuel moves into the air vent hole 41 from the float chamber, it cannot move beyond the highest upper point 32*a* of the first air vent tube 32, because the highest upper point 32*a* has a sufficient head height. This reliably prevents the fuel from going externally through the outer air passage. In addition, the first air vent tube 32 is circularly curved such that its middle portion is higher than its end portions. In other words, since the first air vent tube 32 slopes up to the highest upper point 32*a* from which it slopes down. This prevents accumulation and clogging of the fuel in the first air vent tube 32. As a consequence, the pressure in the float chamber of each of the carburetors U1, U2 is stabilized.

In a case where the vehicle A is traveling in water, if the tip end air vent hole 33*b* provided in the lower portion of the vehicle body and situated below the V-twin engine E is clogged with water, splash mud, or the like, the fluctuation of the pressure in the float chamber of each of the carburetors U1, U2 is avoided because the intermediate air vent hole 36*f* is opened in atmosphere at an upper position of the body.

Since the first air vent tube 32 is provided in the inner space of the air cleaner 21, the position of the second vent relay portion 36 where the first and second air vent tubes 32, 33 are connected can be selected without being disturbed by the engine parts and without making piping complicated. Accordingly, it is possible to easily provide the opening of the air vent in atmosphere at an appropriate position and this configuration has an excellent external design appearance.

While the first air vent tube 32 is circularly formed in the above description, it may have another shapes provided that it slopes up to the highest upper point and slopes down therefrom. For example, the first air vent tube 32 may be inverted-V shaped. Since the highest upper point 32*a* is at a high position, a horizontal portion in the vicinity of the highest upper point 32*a* is not problematic.

While the air vent tube 32 passes through the inside of the air cleaner 21 such that they connect two points of the floor wall of the clean area 23, how the air vent tube 32 passes through the inside of the air cleaner 21 is not limited provided that the air vent tube 32 has a required head height.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended clams are reserved.

What is claimed is:

1. A V-type two cylinder engine comprising:

cylinders arranged forward and rearward such that they are inclined in V shape;

a downdraft carburetor unit having at least two carburetors placed between the cylinders and including twin venturi bores provided for the respective cylinders and an air vent system making the interior of said carburetors communicate with the atmosphere;

intake manifolds each connecting a venturi bore of each of the carburetors to an intake port of a corresponding cylinder; and an air cleaner placed above the carburetors such that it covers the carburetors, wherein the carburetor unit is placed obliquely seen in a plan view according to a positional difference between the cylinders in a direction of a crank shaft of the engine such that the venturi bore of each of the carburetors is closer to the intake port formed in a corresponding cylinder.

2. The V-type two cylinder engine of claim 1, wherein the carburetor unit is placed obliquely such that the venturi bore of each of the carburetors is situated on an extended line of an intake passage formed in a corresponding cylinder.

3. The V-type two cylinder engine of claim 1, wherein the venturi bore of each of the carburetors is placed substantially on a line extending in a direction orthogonal to the crank shaft through the intake port of a corresponding cylinder.

4. The V-type two cylinder engine of claim 1, wherein the air cleaner comprises:

a body having an intake hole formed in a side face thereof and connecting holes connected to the carburetors;

an intake duct connected to an inlet of the intake hole;

a guide passage provided inside of the body and at an outlet of the intake hole for guiding air flowing through the intake hole upward; and a filter placed inside of the body such that it separates a portion downstream from the guide passage into a dirty area continuous with the guide passage and a clean area in which the connecting holes are opened, for filtering air flowing through the guide passage toward the connecting holes.

5. The V-type two cylinder engine of claim 4, wherein the intake hole is provided in a lower end portion of the side face of the body, the intake duct extends obliquely and downward from a tip end thereof and reaches the inlet of the intake hole, the filter is provided in a substantially horizontal direction to allow air flowing through the guide passage to pass through the filter from above and move downward toward the connecting holes, thereby forming a dirty area above the filter and a clean area below the filter with a wall disposed between the guide passage and the clean area, and the connecting holes are provided in a bottom face of the clean area of the body.

6. The V-type two cylinder engine of claim 5, wherein the intake duct has a passage section area gradually increased from the tip end thereof to a base end thereof.

7. The V-type two cylinder engine of claim 1, wherein each of the carburetors of the carburetor unit comprises a float chamber and an air vent passage making the float chamber communicate with the atmosphere, and the air vent passage is guided to inside of the body of the air cleaner, where the air vent passage slopes up to a highest point from which the air vent passage slopes down.

8. The V-type two cylinder engine of claim 7, wherein the air vent passage comprises an inner air passage making the float chamber of the carburetor communicate with the atmosphere and an outer air passage extended from the inner air passage, the outer air passage comprises:

a first outer air passage extending from an outlet of the inner air passage through inside of the air cleaner to an exit portion provided in the air cleaner; and a second outer air passage extended from the exit portion of the air cleaner, and a tip end of the second outer air passage is opened in the atmosphere.

9. The V-type two cylinder engine of claim 8, wherein the second outer air passage extends downward from the exit portion provided in the air cleaner, and an intermediate air vent hole is provided in the exit portion so as to open a base end of the second air passage in the atmosphere.

10. A straddle-type four wheel all terrain vehicle comprising:

a straddle-type seat;

a steering handle provided forward of the seat;

a top cover covering an upper portion of a vehicle body, through which a rotating shaft of the steering handle penetrates; and a V-type two cylinder engine mounted below the seat and the handle and between the seat and the handle, wherein the V-type two cylinder engine comprises:

cylinders arranged forward and rearward such that they are inclined in V shape;

a downdraft carburetor unit having at least two carburetors placed between the cylinders and including twin venturi bores provided for the respective cylinders and an air vent system making the interior of said carburetors communicate with the atmosphere;

intake manifolds each connecting a venturi bore of each of the carburetors to an intake port of a corresponding cylinder; and an air cleaner placed above the carburetors such that it covers the carburetors, wherein the carburetor unit is placed obliquely seen in a plan view according to a positional difference between the cylinders in a direction of a crank shaft of the engine such that the venturi bore of each of the carburetors is closer to the intake port formed in a corresponding cylinder.

11. The straddle-type four wheel all terrain vehicle of claim 10, further comprising: a relay chamber formed inside of the top cover, the relay chamber being surrounded by a separating wall and having a clearance between the rotating shaft of the handle and the top cover for introducing fresh air, wherein an opening of the air cleaner for introducing fresh air is opened inside of the relay chamber.

12. The straddle-type four wheel all terrain vehicle of claim 11, wherein the top cover has a swelled portion which is raised upward around the rotating shaft and the relay chamber is formed inside of the swelled portion.

13. The straddle-type four wheel all terrain vehicle of claim 10, wherein the air vent system includes an air vent passage connecting the carburetors and atmosphere and the air vent passage has a portion passing through inside of the air cleaner and a tip end opened in atmosphere.

14. The straddle-type four wheel all terrain vehicle of claim 10, wherein the air cleaner comprises:

a body having an intake hole provided in a side face thereof and connecting holes connected to the carburetors;

an intake duct connected to an inlet of the intake hole;

a guide passage provided inside of the body and at an outlet of the intake hole for guiding air flowing through the intake hole upward; and a filter placed inside of the body such that it separates a portion downstream from the guide passage into a dirty area continuous with the guide passage and a clean area in which the connecting holes are opened, for filtering air flowing through the guide passage to the connecting holes, wherein the intake duct has a tip end opened inside of the top cover and extends obliquely and downward to reach the inlet of the intake hole, the filter is provided in a substantially horizontal direction to allow air flowing through the guide passage to pass through the filter from above and move downward toward the connecting holes, thereby forming a dirty area above the filter and a clean area below the filter with a wall disposed between the guide passage and the clean area, and the connecting holes are provided in a bottom face of the clean area of the body.

15. The straddle-type four wheel all terrain vehicle of claim 11, wherein the air cleaner comprises:

a body having an intake hole provided in a side face thereof and connecting holes connected to the carburetors;

an intake duct connected to an inlet of the intake hole;

a guide passage provided inside of the body and at an outlet of the intake hole for guiding air flowing through the intake hole upward; and a filter placed inside of the body such that it separates a portion downstream from the guide passage into a dirty area continuous with the guide passage and a clean area in which the connecting holes are opened, for filtering air flowing through the guide passage to the connecting holes, wherein the intake duct has a tip end opened inside of the relay chamber and extends obliquely and downward from a tip end thereof to reach the inlet of the intake hole, the filter is provided in a substantially horizontal direction to allow air flowing through the guide passage to pass through the filter from above and move downward toward the connecting holes, thereby forming a dirty area above the filter and a clean area below the filter with a wall disposed between the guide passage and the clean area, and the connecting holes are provided in a bottom face of the clean area of the body.

* * * * *